US006179221B1

(12) United States Patent
Goldberg et al.

(10) Patent No.: US 6,179,221 B1
(45) Date of Patent: Jan. 30, 2001

(54) FIXED SPRAY SPRINKLER WITH FLOW SHUT OFF VALVE

(75) Inventors: Allan M. Goldberg, Laguna Nigel; James W. Zimmerman, Walnut; Joseph Daniel Mason, Big Bear City, all of CA (US)

(73) Assignee: The Torro Company, Minneapolis, MN (US)

( * ) Notice: Under 35 U.S.C. 154(b), the term of this patent shall be extended for 0 days.

(21) Appl. No.: 09/395,807

(22) Filed: Sep. 14, 1999

Related U.S. Application Data

(60) Provisional application No. 60/100,161, filed on Sep. 14, 1998.

(51) Int. Cl.[7] ..... B05B 15/02

(52) U.S. Cl. ..... 239/106; 239/579; 239/570

(58) Field of Search ..... 239/114, 123, 239/579, 569, 600, 106, 570

(56) References Cited

U.S. PATENT DOCUMENTS

| | | | | |
|---|---|---|---|---|
| 4,393,992 | * | 7/1983 | Strunk et al. | 239/570 |
| 4,562,962 | | 1/1986 | Hartman . | |
| 4,736,889 | * | 4/1988 | Stephenson | 239/204 |
| 4,867,603 | * | 9/1989 | Chang | 405/37 |
| 5,174,500 | | 12/1992 | Yianilos . | |
| 5,372,306 | | 12/1994 | Yianilos . | |
| 5,524,824 | | 6/1996 | Frimmer . | |
| 5,758,682 | * | 1/1998 | Cain | 137/68.14 |
| 5,857,487 | * | 1/1999 | Carson et al. | 137/519 |
| 6,000,632 | * | 12/1999 | Wallace | 239/570 |

* cited by examiner

*Primary Examiner*—Andres Kashnikow
*Assistant Examiner*—Christopher S. Kim
(74) *Attorney, Agent, or Firm*—James W. Miller

(57) ABSTRACT

A sprinkler for watering a fixed spray pattern includes a flow conduit having a nozzle coupled thereto. A filter screen is held in place beneath the nozzle. The filter screen engages against a poppet type valve member of a flow shut off valve to space the valve member away from a valve seat to permit water flow through the flow conduit when the filter screen and nozzle are in place. If the nozzle is removed, the filter screen can move far enough upwardly, or can itself also be removed, that the valve member closes to shut off flow through the flow conduit. The flow shut off valve is located at a fixed distance from a reference point in the top of the flow conduit to permit the same sized screen to open the valve regardless of the overall length of the flow conduit. A flush cap used initially on top of the flow conduit in place of the nozzle, i.e. during shipment and initial pressurization and flushing of the flow conduit, has a downwardly extending extender finger which interacts with the shut off valve in the same manner as the filter screen to open the shut off valve whenever the flush cap is in place.

13 Claims, 6 Drawing Sheets

FIXED SPRAY SPRINKLER WITH FLOW SHUT OFF VALVE

Cross Reference to Related Applications

This application claims the benefit of one or more previously filed copending provisional applications identified as follows: application Ser. No. 60/100,161 filed Sep. 14, 1998.

TECHNICAL FIELD

This invention relates to a fixed spray sprinkler having a flow shut off valve.

BACKGROUND OF THE INVENTION

Fixed spray sprinklers are well known which comprise a fixed spray nozzle that is threaded onto the top of a flow conduit. Both the nozzle and the conduit are considered "fixed" because they do not rotate about their axes during operation of the sprinkler. The nozzle might be adjustable to vary the spray. However, once the nozzle is initially adjusted to provide a particular spray, that spray covers a particular area of the ground without rotating or moving the spray relative to the ground. This characteristic gives rise to the term "fixed spray sprinkler".

U.S. Pat. No. 4,562,962 to Hartman discloses a fixed spray sprinkler of this type equipped with a flow shut off valve. The flow shut off valve comprises a poppet valve that is normally held open by a physical engagement with some portion of the sprinkler nozzle. If the sprinkler nozzle is broken or removed, the valve closes to prevent water from gushing out through the flow conduit. The valve is located adjacent the bottom of the flow conduit.

In fixed spray sprinklers, an array of flow conduits with different lengths are desirable to be able to position the nozzle at different heights above the ground. Since the Hartman shut off valve is held open by engaging against some portion of the nozzle, and since the shut off valve is adjacent the bottom of the flow conduit, the length of whatever is used to hold the shut off valve open must vary along with the length of the flow conduit. This greatly complicates the manufacture of sprinklers with such flow shut off valves, making such sprinklers more expensive.

In addition, many sprinkler manufacturers build and ship fixed spray sprinklers without pre-installed nozzles, but with a flush cap used on the top of the flow conduit in place of a nozzle. The flush cap prevents dirt or debris from entering the flow conduit during shipment and sprinkler installation. However, once the sprinkler is installed but before the flush cap is removed, the sprinkler system is pressurized for the first time. The flush cap is designed to let water exit or flush out through the cap during this initial pressurization to flush out any debris that might inadvertently have gotten inside the sprinkler. After this initial flush, the flush caps are removed and replaced with nozzles.

If flow shut off valves are installed inside the flow conduits, they will seal and shut off the flow during the initial pressurization of the system. Thus, the desired initial flush through the flush caps cannot occur. Accordingly, the use of flow shut off valves in fixed spray sprinklers is seemingly inconsistent with the use of flush caps. No fixed spray sprinklers having flush caps have ever been equipped with flow shut off valves.

SUMMARY OF THE INVENTION

One aspect of this invention is to provide a fixed spray sprinkler having a flow shut off valve located a fixed distance from the top of the flow conduit, or from some other fixed reference point in the top portion of the flow conduit such as the lower end of a filter screen beneath the nozzle. Thus, the operation of the flow shut off valve is independent of the length of the flow conduit. This sprinkler apparatus, and the associated manufacturing method of letting the location of the flow shut off valve be constant relative to the nozzle instead of to the bottom of the flow conduit, allows a common flow shut off valve to be used across an entire line of fixed spray sprinklers having flow conduits of different lengths.

Another aspect of this invention allows for the flush cap that is initially shipped on top of the flow conduit to be used to keep the flow shut off valve open during the initial system pressurization and flush. After this has occurred and the flush cap is removed, the flow shut off valve will be able to close.

In a further aspect of this invention, the flush cap can initially position the valve member of the flow shut off valve beneath the valve seat in a non-assembled position to provide maximum clearance for the flush of debris through the flow conduit. The act of removing the flush cap is used to assemble the valve member and the valve seat together.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
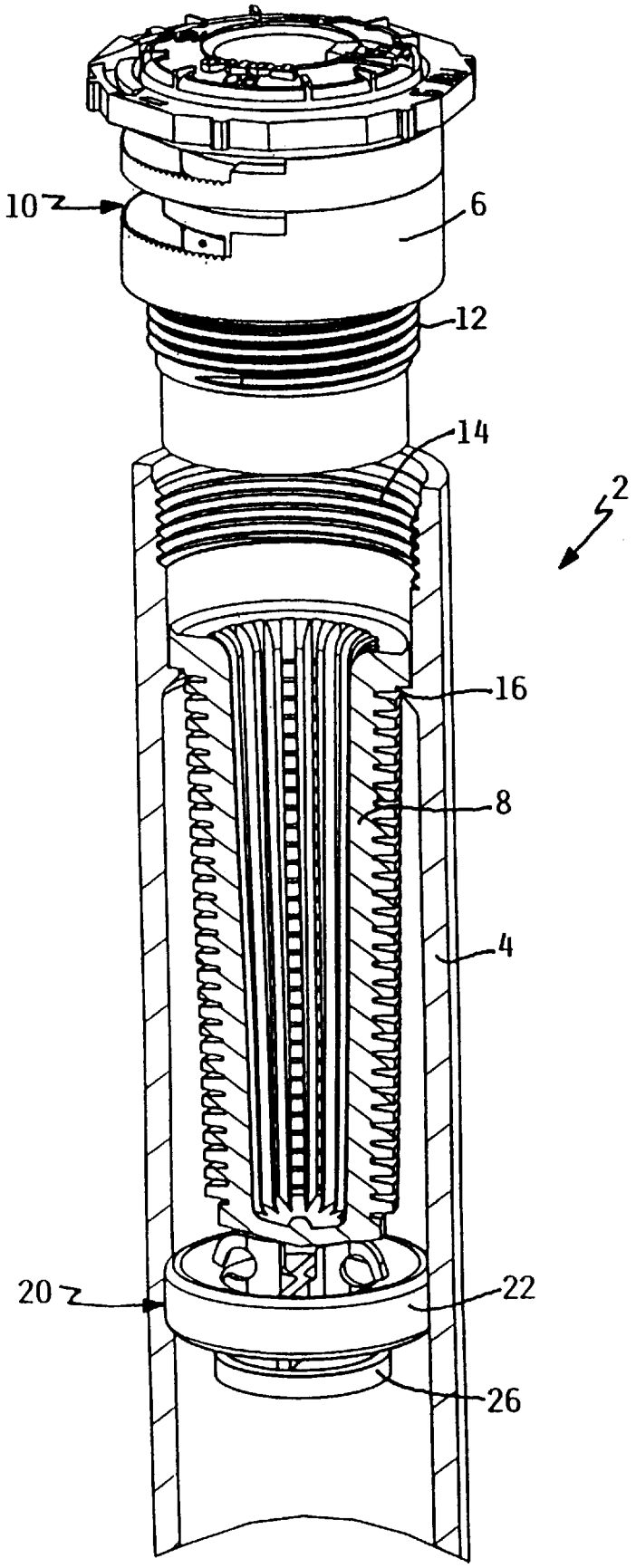
FIG. 1 is a perspective view, partly in cross-section, of a portion of a fixed spray sprinkler, showing a first embodiment of the improved flow shut off valve of this invention installed in a flow conduit beneath a fixed spray nozzle.

A portion of a conventional fixed spray sprinkler 2 is shown in FIG. 1. The portion that is shown comprises the top portion of the flow conduit 4 that mounts the nozzle 6, a filter screen 8 used in the top portion of flow conduit 4 beneath nozzle 6, and nozzle 6 that mounts to the top of flow conduit 4. Nozzle 6 is shown in an exploded relationship relative to flow conduit 4. Normally, nozzle 6 would be engaged with the top of flow conduit 4.

Nozzle 6 has one or more water discharge orifices 10 that determine the direction and shape of the spray exiting from sprinkler 2. Nozzle 6 might be adjustable so that the spray direction and shape can be adjusted using only one nozzle 6. Alternatively, various different nozzles 6 might be provided, with each one being used to provide a particularly shaped and directed spray. In this latter event, one changes the spray by replacing nozzles 6 rather than by adjusting a single nozzle. In any event, such fixed spray sprinkler nozzles 6 are quite well known and need not be further described herein.

Nozzle 6 has exterior screw threads 12 on the lower portion thereof. These screw threads 12 can be threaded into engagement with some threads 14 provided on an inside diameter of flow conduit 4 adjacent the top of flow conduit 4. When nozzle 6 is threaded into engagement with flow conduit 4 and is tightened down on flow conduit 4, the bottom of nozzle 6 forces filter screen 8 down against a locating rib 16. Thus, nozzle-6 serves to retain filter screen 8 within flow conduit 4 when nozzle 6 is installed.

Figure 3:
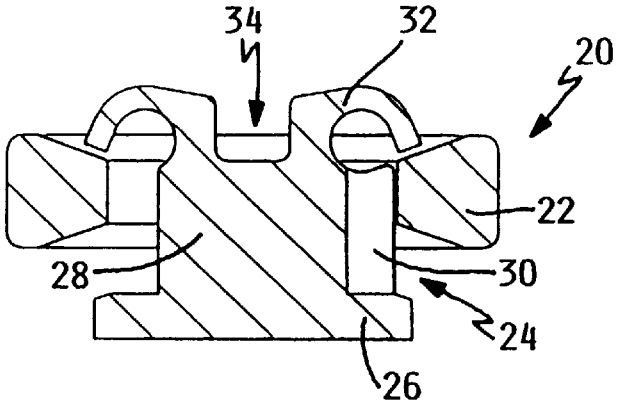
FIG. 3 is a cross-sectional view of the first embodiment of the flow shut off valve of this invention shown in FIG. 1, taken along Lines 3—3 of FIG. 2.
Figure 2:
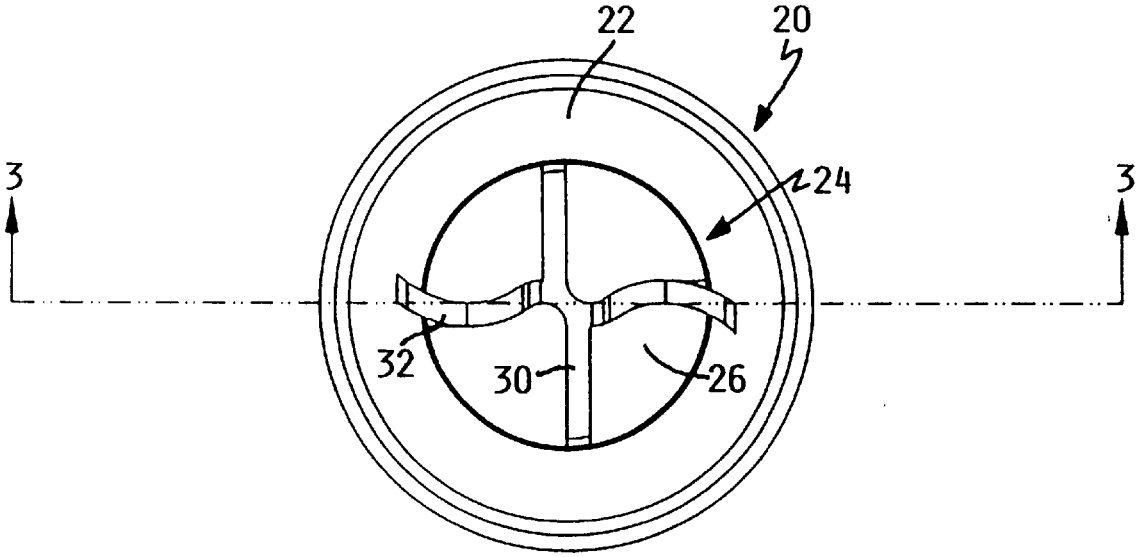
FIG. 2 is a top plan view of the first embodiment of the flow shut off valve of this invention shown in FIG. 1.

Referring to FIGS. 2 and 3, the flow shut off valve of this invention is generally illustrated as 20. Flow shut off valve 20 has two major components:

an annular, ring-shaped valve seat 22, and a poppet type valve member 24 assembled to valve seat 22.

Figure 4:
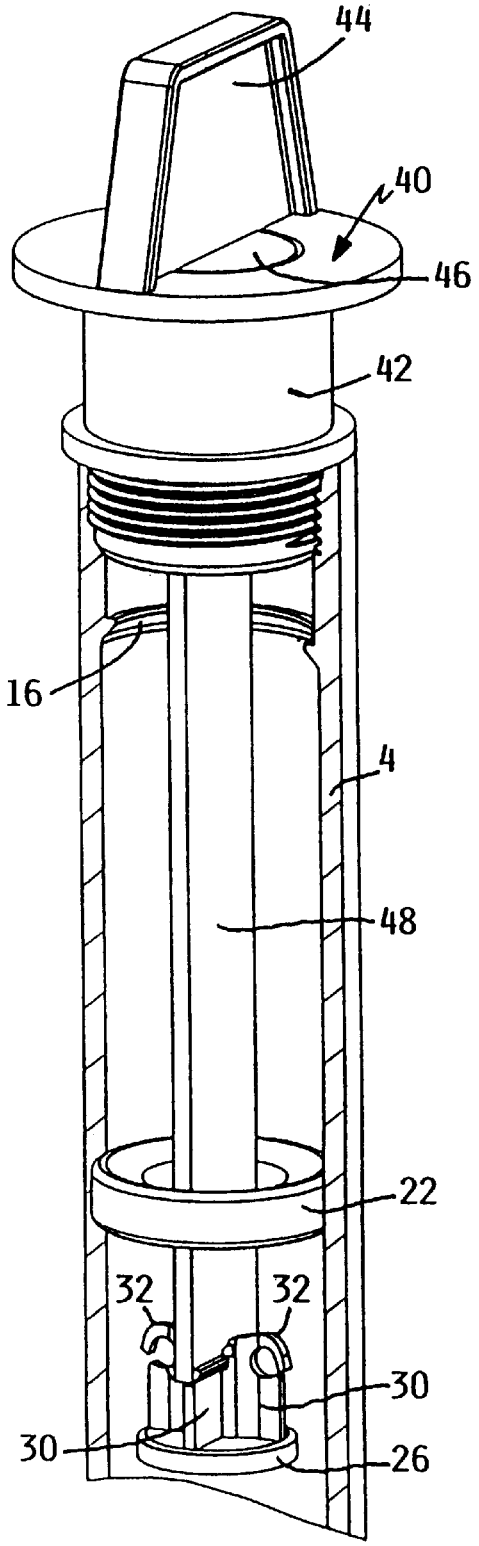
FIG. 4 is a perspective view, partly in cross-section, of a portion of a fixed spray sprinkler, showing the first embodiment of the flow shut off valve of this invention shown in FIG. 1 held by a flush cap in a pre-assembled condition.

FIGS. 1–3 show these two components of flow shut off valve 20 in an assembled condition. FIG. 4 illustrates the same components in an unassembled condition.

Valve member 24 includes a circular valve plate 26 that is designed to seal against valve seat 22 to shut off any flow through valve seat 22. An upwardly extending stem 28 is carried on valve plate 26 and is integrally molded therewith. Stem 28 is designed to abut against the bottom of filter screen 8 when nozzle 6 is installed with filter screen 8 serving to hold valve 20 open by spacing valve plate 26 away from valve seat 22. When nozzle 6 is removed and filter screen 8 is thus free to move upwardly, the force of water flowing through flow conduit 4 will move valve member 24 upwardly until valve plate 26 seals against valve seat 22, thereby shutting off flow through flow conduit 4.

Stem 28 of valve member 24 is made of a plurality of spiders 30 that form an X or cross-shape. Spiders 30 are sized to be received within valve seat 22 to guide the movement of valve member 24 up and down. Two opposed spiders 30 terminate in upper flexible arms 32 that bend downwardly in mushroom type shape and extend radially outwardly to a diameter that is slightly larger than the inner diameter of the opening in valve seat 22. A central gap 34 is provided between such arms 32. See FIG. 3.

In assembling valve member 24 to valve seat 22, valve member 24 can be pushed upwardly through valve seat 22 which flexes arms 32 downwardly enough to allow stem 28 to pass up through valve seat 22. Once this assembly is completed, arms 32 spring apart and will thereafter resist disassembly of valve member 24 from valve seat 22. In other words, once valve member 24 has its stem 28 inserted through valve seat 22, it cannot thereafter be pulled back out but remains in an assembled state. Obviously, even in it's assembled state, valve member 24 can move up and down relative to valve seat 22 to close and open as is typical in a poppet type valve 20.

This invention relates to a flow shut off valve 20 that is installed at a fixed distance below the top of flow conduit 4 or at a fixed distance from some other reference point, such as from the location of the bottom of filter screen 8 when filter screen 8 is being held in place by nozzle 6. Desirably, this is done during manufacture by a fixture that press fits valve seat 22 up through the bottom of flow conduit 4 and locates valve seat 22 at a precise distance from the reference point. A rib (not shown in FIG. 1 but shown as 23 in FIG. 6) on the internal diameter of flow conduit 4 could be provided to assist in the proper location of flow shut off valve 20. Once the top of valve seat 22 abuts against the underside of such a rib, valve seat 22 would be located at the right spot. However, a locating rib is not strictly necessary as many modern manufacturing fixtures could accurately and precisely assemble flow shut off valve 20 into flow conduit 4.

If flow shut off valve 20 is installed at a fixed distance below the top of flow conduit 4 or at a fixed distance from some other reference point as described earlier, then the same valve 20 will work across an entire line of fixed spray sprinklers 2 having different lengths of flow conduits 4. In other words, it is not relevant that flow conduit 4 is 2 inches long, or 6 inches long, or 12 inches long. The same flow shut off valve 20 will work in each as long as filter screens 8 are the same size in each sprinkler 2, as they typically are. Thus, the cost and complexity of using flow shut off valves 20 in fixed spray sprinklers 2 of the type shown herein is greatly diminished. This will encourage the incorporation of such valves into such sprinklers.

Referring now to FIG. 4, a flush cap is shown generally as 40. Flush cap 40 comprises a threaded cylindrical body 42 that is threaded onto the top of flow conduit 4 in place of nozzle 6 when sprinkler 2 is shipped by the manufacturer. Flush cap 40 has an upper surface provided with a handle 44 for rotating cap 40 to remove cap 40 after sprinkler 2 is installed in a sprinkler system. The upper surface of flush cap 40 has a flexible tab 46 that will bend upwardly under water pressure to perform a flushing action if flush cap 40 is in place on flow conduit 4 during an initial pressurization of the sprinkler system in which sprinkler 2 is installed. Such flush caps 40 used on fixed spray sprinklers 2 are well known in the irrigation art.

If a flush cap 40 is to be used on flow conduit 4 in place of nozzle 6, at least during shipment of sprinkler 2 and during sprinkler installation and initial pressurization of the sprinkler system, flow shut off valve 20 shown in FIG. 1 would normally prevent the flushing action which is desired through flush cap 40.

In FIG. 4, a flush cap 40 according to this invention is shown having a downwardly depending flange or extender finger 48. At a minimum, extender finger 48 is long enough to engage stem 28 of flow shut off valve 20 and hold valve plate 26 open in the same manner as filter screen 8 would. Thus, with flush cap 40 in place, this would permit water to flow through flow shut off valve 20 during initial pressurization and then out through flexible tab 46 in flush cap 40 as it normally would. When flush cap 40 is removed and replaced with a nozzle 6 and filter screen 8 combination as shown in FIG. 1, then filter screen 8 thereafter performs the function of normally holding flow shut off valve 20 open.

If extender finger 48 on flush cap 40 is only long enough so that it functions much like filter screen 8, then the distance between valve seat 22 and valve plate 26 in the fully open position of flow shut off valve 20 is still relatively small. Larger pieces of debris might be caught in this gap during the initial flushing action.

To prevent this, and as shown in FIG. 4, extender finger 48 on flush cap 40 could be made sufficiently long such that valve member 24 is held well beneath valve seat 22 in an unassembled position when flush cap 40 is threaded onto the top of flow conduit 4. As shown in FIG. 4, sprinkler 2 would be shipped by the manufacturer with valve member 24 not yet having been inserted through valve seat 22. extender finger 48 on flush cap 40 carries valve member 24 beneath valve seat 22.

Figure 5:
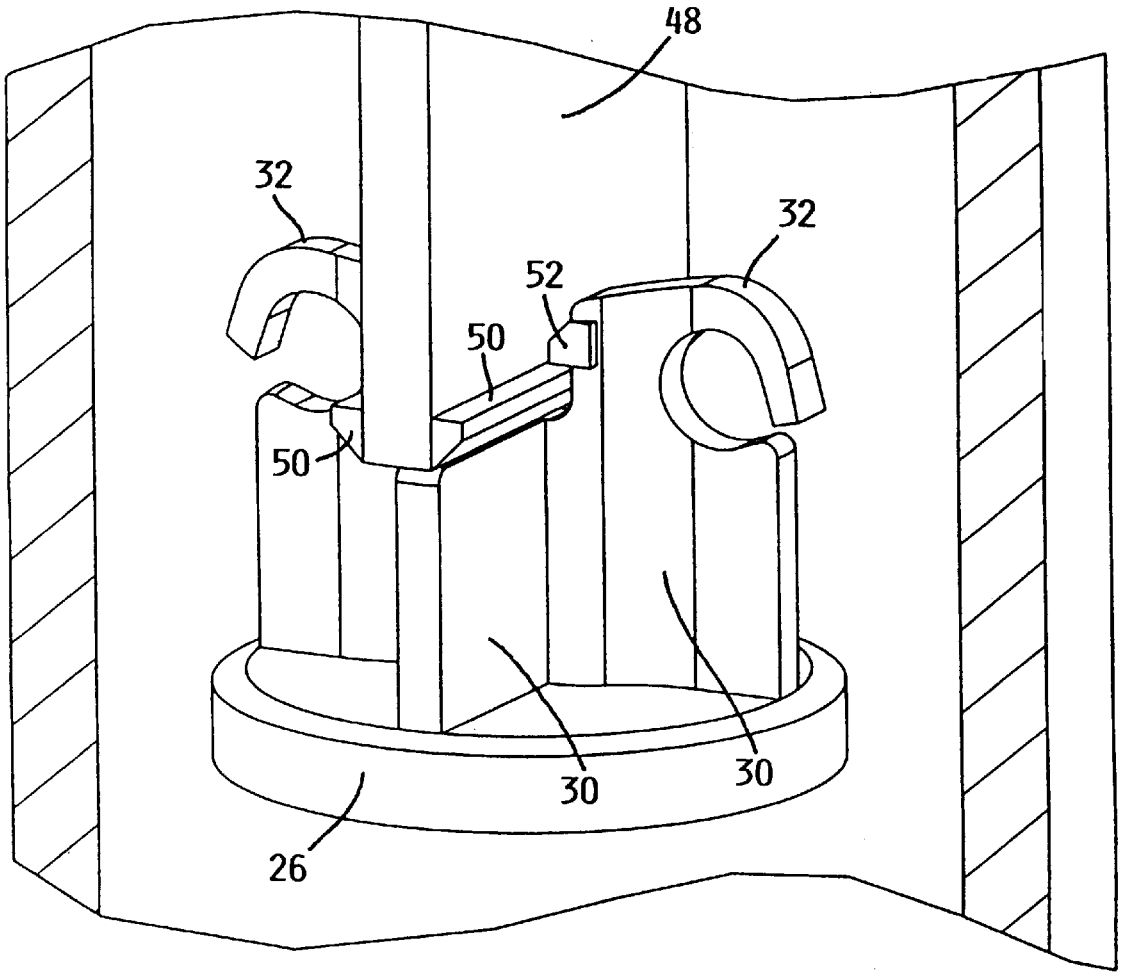
FIG. 5 is an enlarged perspective view showing the connection between the flush cap and the first embodiment of the flow shut off valve of this invention shown in FIG. 1.

Flush cap extender finger 48 is inserted into gap 34 between flexible arms 32 of stem 28 of valve member 24 such that valve member 24 is carried on the bottom of flush cap extender finger 48. The bottom of flush cap extender finger 48 is provided with a ridge 50 on either side that cooperates with a detent 52 on the back side of each flexible arm 32 as shown more clearly in FIG. 5. This ridge/detent feature serves to releasably couple valve member 24 to the bottom of flush cap extender finger 48. Arms 32 can still flex inwardly sufficiently to pass through valve seat 22, and the ridge/detent feature is sufficiently strong to pull valve member 24 up through valve seat 22.

When flush cap 40 in FIG. 4 is unscrewed and pulled upwardly to remove it from flow conduit 4, flush cap extender finger 48 will pull upwardly on valve member 24 until valve member 24 passes through valve seat 22. As stem 28 of valve member 24 passes upwardly through valve seat 22, arms 32 will flex inwardly enough to allow stem 28 to pass up through valve seat 22 without becoming disconnected from arms 32. Once valve plate 26 abuts against valve seat 22, however, continued upward movement of flush cap 40 will pull ridges 50 on the bottom of flush cap extender finger 48 past detents 52 on arms 32 to disconnect flush cap 40 from valve member 24. In the moment of disconnection, flexible arms 32 are able to flex slightly outwardly to permit ridges 50 to get past detents 52. Flush cap 40 is then free to be pulled completely outwardly from flow conduit 4 with valve member 24 now being retained in valve seat 22 just as if it were pre-assembled at the factory.

Flush cap 40 as shown in FIG. 4 completes the assembly of flow shut off valve 20 during the removal of flush cap 40 in the field after an initial flushing action has occurred through flush cap 40. The advantage of doing this is that the gap or opening through which debris can pass through valve seat 22 is much larger than when valve 20 is assembled so that any large pieces of debris can flush out during initial pressurization. Most larger pieces of debris are likely to be in flow conduit 4 or the supply lines leading thereto only initially so that the initial flush will remove such larger pieces of debris. Thus, the smaller normal gap between valve plate 26 and valve seat 22 that is present thereafter, i.e. after removal of flush cap 40 actually assembles the two together, is sufficient to allow the debris pieces that are normally seen after the sprinkler installation is complete and after the initial pressurization to pass through flow shut off valve 20.

Instead of a poppet type shut off valve 20 as shown in FIGS. 1–5, a captured ball valve could be used as the shut off valve. Such a ball valve would be retained or captured immediately below the valve seat 22 which would have its lower side shaped to seal against the curved upper surface of the ball valve. Screen 8 might be modified to have a downwardly extending tab or flange or extender finger that would pass through valve seat 22 to engage against the upper side of the ball valve to hold the ball valve open when screen 8 and nozzle 6 are both in place.

Figure 6:
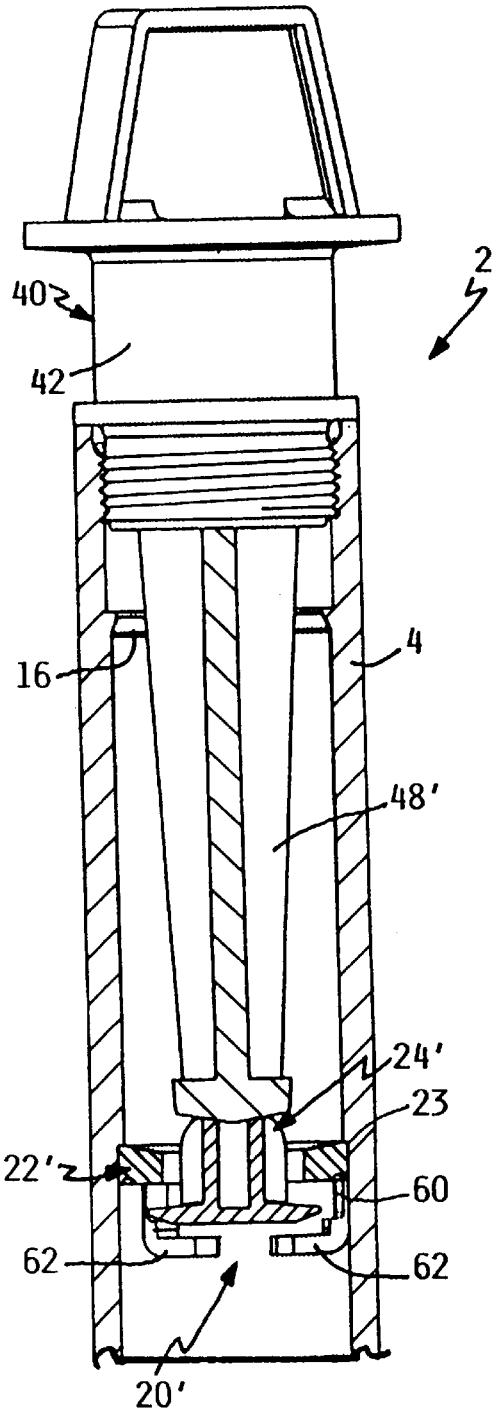
FIG. 6 is a side elevational view, partly in cross-section, of a portion of a fixed spray sprinkler, showing a second embodiment of the improved flow shut off valve of this invention installed in a flow conduit with the flow shut off valve being held open by a flush cap.
Figure 8:
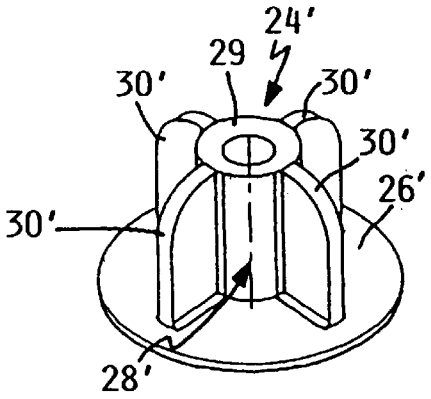
FIG. 8 is a perspective view of the other component of the second embodiment of the flow shut off valve of this invention shown in FIG. 6, namely a perspective view of the poppet type valve member.
Figure 7:
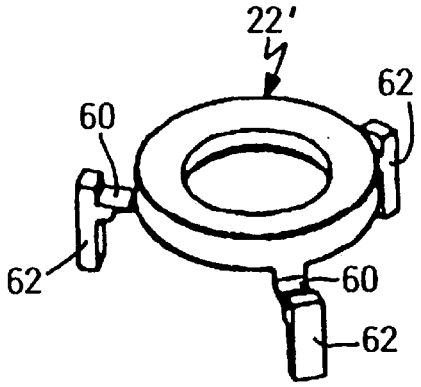
FIG. 7 is a perspective view of one component of the second embodiment of the flow shut off valve of this invention shown in FIG. 6, namely a perspective view of the valve seat shown before the valve seat is installed in the flow conduit.

Referring now to FIGS. 6–8, a second embodiment of a flow shut off valve according to this invention is illustrated as 20'. Again, flow shut off valve 20' has two major components:

an annular, ring-shaped valve seat 22', and a poppet type valve member 24' assembled to valve seat 22'.

Referring first to FIG. 8, valve member 24' includes a horizontal valve plate 26' having an upwardly extending stem 28'. Stem 28' is in the form of a cylindrical hub 29 having a plurality of spiders 30' in an X or cross-shape extending radially outwardly from the hub 29. Unlike valve member 24 in the first embodiment of flow shut off valve 20, valve member 24' has no flexible arms 32. All the components of valve member 24', namely valve plate 26' and stem 28' formed as a cylindrical hub 29 with spiders 30' extending radially outwardly from hub 29, are molded integrally with one another and are rigid or non-movable relative to one another.

Since valve member 24' has no parts which can flex inwardly relative to one another when assembling valve member 24' to the valve seat, another way of assembling these two components to one another must be used. Thus, referring now to FIG. 7, valve seat 22' includes a plurality of bendable or foldable legs 60 having retaining tabs 62 thereon. Before valve member 24' is assembled to valve seat 22', tabs 62 extend vertically downwardly as shown in FIG. 7. In this position, sufficient clearance is provided between tabs 62 and valve member 24' such that stem 28' and spiders 30' of valve member 24' can be pushed up through valve seat 22' until valve plate 26' is immediately beneath valve seat 22'. Then, the bendable legs 60 are folded inwardly until tabs 62 become approximately horizontal and underlie valve member 24'. In this position, tabs 62 retain valve member 24' within valve seat 22' and prevent valve member 24' from falling out of valve seat 22'. After valve member 24' and valve seat 22' are assembled in this fashion to form a complete flow shut off valve 20', the assembled flow shut off valve 20' can then be positioned within flow conduit 4 as noted with respect to the first embodiment 20 of the flow shut off valve, to abut against locating rib 23 when such a rib 23 is used in conduit 4.

Referring now to FIG. 6, flow shut off valve 20' is shown in place within flow conduit 4. A flush cap 40 is shown screwed onto the top of flow conduit 4. Flush cap 40 includes a flush cap extender finger 48' having an X or cross shape rather than a simple flat shape as in FIGS. 1–5. The lower end of flush cap extender finger 48' will physically abut or engage against the top of stem 28' or valve member 24' to hold valve 20' open. In other words, flush cap extender finger 48' and its engagement with valve member 24' keeps valve plate 26' spaced away from valve seat 22' so that water can pass around valve plate 26' and flow through valve seat 22'. Thus, with flush cap 40 in place, valve 20' will be held open during initial pressurization and flushing of flow conduit 4.

After flow conduit 4 has been flushed as part of its installation, flush cap 40 can them be removed by screwing flush cap 40 off the top end of flow conduit 4. Screen 8 and nozzle 6 can then be installed as noted with respect to the first embodiment 20 of the flow shut off valve. When screen 8 and nozzle 6 are in place, screen 8 then serves to abut against the top of stem 28' to hold flow shut off valve 20' open. However, if nozzle 8 should be removed such that screen 8 is free either to be removed or to move upwardly, then any subsequent pressurization of flow conduit 4 will cause flow shut off valve 20' to close with valve plate 26' sealing against valve seat 22'. Thus, the operation of flow shut off valve 20' is identical to that of valve 20.

Flush cap 40 and extender finger 48' could be integrally molded as a single piece. However, keeping in mind that flush cap 40 is also used on sprinklers that might not be equipped with a shut off valve 20 or 20' according to this invention, extender finger 48' could be molded as a separate part which is merely press fit into flush cap 40. Thus, common flush caps 40 could be used across an entire line of sprinklers. When the sprinklers are equipped with flow shut off valves 20 or 20', extender fingers 48' would simply be inserted into only those flush caps 40 used on sprinklers with these flow shut off valves.

Figure 9:
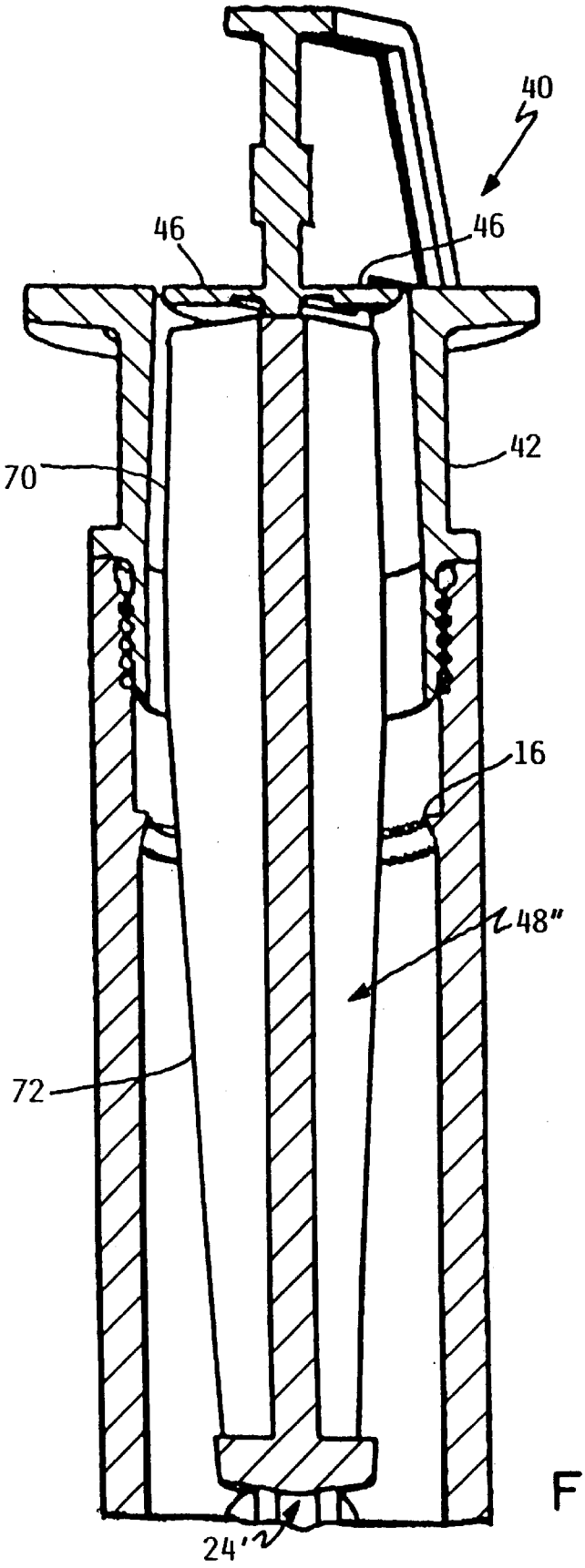
FIG. 9 is a side-elevational view, partly in cross-section, of another version of a flush cap used to hold the flow shut off valve of this invention open, illustrating the use of an extender finger on the flush cap which is not integrally molded with the flush cap but is press fit into the flush cap.

FIG. 9 illustrates an extender finger 48" having an X or cross shape that is a separate part inserted into flush cap 40. In this configuration, the cylindrical body 42 of flush cap 40 carries the screw threads which permit flush cap 40 to be threaded into flow conduit 4. Cylindrical body 42 of flush cap 40 is open from the bottom to allow water to pass through flush cap 40 and eventually exit past flexible tabs 46. Extender finger 48" is provided with an X or cross shape and includes a cylindrical upper section 70 and a tapered lower section 72. Upper section 70 of finger 48" is sized to be received within cylindrical body 42 of flush cap 40 with a press fit that allows finger 48" to be inserted into flush cap 40 or pulled out of flush cap 40. When finger 48" is press fit into flush cap 40, the press fit is preferably tight enough so that flush cap 40 will carry finger 48" with it as it is screwed, unscrewed, or lifted up.

Various modifications of this invention will be apparent to those skilled in the art. Thus, the scope of this invention is to be limited only by the appended claims.

We claim:

1. A sprinkler, which comprises:

(a) a flow conduit having a top portion;

(b) a sprinkler nozzle releasably coupled to the top portion of the flow conduit;

(c) a filter screen having an upper end which is held between the nozzle and a locating surface within the flow conduit when the nozzle is coupled to the top portion of the flow conduit, the filter screen extending downwardly within the flow conduit to terminate in a lower end that is spaced beneath the nozzle;

(d) a flow shut off valve within the flow conduit, which comprises:

(i) a valve seat having an annular, ring shape;

(ii) a valve member that can be moved out of and into engagement with the valve seat to open and close the flow conduit to the passage of water, the valve member being engaged by the lower end of the filter screen to space the valve member away from the valve seat to open the flow conduit to the passage of water when the nozzle and filter screen are installed in the top portion of the flow conduit, the valve member being disengaged sufficiently by the lower end of the filter screen when the nozzle is removed to permit the valve member to engage the valve seat to close the flow conduit to the passage of water when the nozzle is removed, the valve member comprising a poppet valve member that includes a stem that extends through the valve seat when the valve seat and valve member are joined together;

(iii) wherein the valve seat and valve member are insertable as a unit into the flow conduit after the valve seat and valve member are joined together; and (iv) wherein the valve seat includes a plurality of foldable leas having tabs thereon, the legs having a first orientation relative to the valve seat allowing the stem of the valve member to be inserted through the valve seat, the leas being bendable from the first orientation thereof to a second orientation in which the tabs on the legs underlie the valve member to retain the valve member within the valve seat; and (e) wherein the flow shut off valve is located a fixed distance from a reference point in the top portion of the flow conduit so that a common filter screen can be used to engage the valve member in flow conduits of varying length.

2. The sprinkler of claim 1, further including a flush cap which is installed on the top portion of the flow conduit in place of the nozzle and filter screen, the flush cap allowing water to exit therefrom during initial pressurization of the flow conduit to flush debris from the flow conduit, the flush cap having a portion abutting against the valve member to hold the valve member open during initial pressurization of the flow conduit to permit flushing to occur.

3. The sprinkler of claim 1, further including a locating rib in the flow conduit against which the valve seat is installed to properly position the flow shut off valve within the flow conduit.

4. A sprinkler, which comprises:

(a) a flow conduit;

(b) a sprinkler nozzle releasably coupled to the flow conduit;

(c) a flow shut off valve beneath the sprinkler nozzle, the flow shut off valve being open when the sprinkler nozzle is coupled to the flow conduit to permit water to pass through the flow conduit and being closed when the sprinkler nozzle is removed from the flow conduit to black water flow through the flow conduit; and (d) a flush cap that is releasably coupled to the flow conduit in place of the nozzle, the flow shut off valve being open when the flush cap is coupled to the flow conduit to permit water to pass through the flow conduit during flushing of the flow conduit when the flush cap is in place.

5. The sprinkler of claim 4, wherein the flow shut off valve is located within the flow conduit.

6. The sprinkler of claim 4, wherein the flush cap includes an extender finger that extends down to engage the flow shut off valve to open the flow shut off valve when the flush cap is coupled to the flow conduit.

7. The sprinkler of claim 6, wherein the extender finger and flush cap are integrally molded together to form a single piece.

8. The sprinkler of claim 6, wherein the extender finger and flush cap are separate pieces, and the extender finger is press fit into an aperture in the flush cap.

9. A flush cap for a sprinkler having a flow conduit, a nozzle releasably coupled to one end of the flow conduit for sprinkling water therefrom, and a flow shut off valve for closing water flow through the flow conduit when the nozzle is removed, which comprises:

a flush cap that is releasably attachable to the one end of the flow conduit in place of the nozzle during shipment and installation of the sprinkler, the flush cap having a portion thereof in engagement with the flow shut off valve to hold the flow shut off valve open to allow water to pass through the flow conduit during initial pressurization of the flow conduit while the flush cap is still attached to the flow conduit before the nozzle is installed on the flow conduit.

10. The flush cap of claim 9, wherein the portion of the flush cap that engages the flow shut off valve comprises at least one extender finger that protrudes from the flush cap into contact with the flow shut off valve.

11. The flush cap of claim 10, wherein the extender finger is a separate part from the flush cap and extends between the flush cap and the flow shut off valve.

12. The flush cap of claim 11, wherein the extender finger is press fit into the flush cap.

13. The flush cap of claim 12, wherein the extender finger has an X or cross shape including a cylindrical upper portion, the cylindrical upper portion of the extender finger being press fit into a hollow cylindrical body of the flush cap.

* * * * *

UNITED STATES PATENT AND TRADEMARK OFFICE

CERTIFICATE OF CORRECTION

PATENT NO. : 6,179,221 B1
DATED : January 30, 2001
INVENTOR(S) : Allan M. Goldberg et al.

It is certified that error appears in the above-identified patent and that said Letters Patent is hereby corrected as shown below:

On the Title Page in the identification of the Assignee,
"The Torro Company" should read --The Torro Company.

Column 7, claim 1,
Lines 63 and 66 "leas" should read -- legs --

Column 8, claim 4,
Line 28, "black" should read --block--

Signed and Sealed this

Thirty-first Day of July, 2001

*Attest:*

Nicholas P. Godici

*Attesting Officer*

NICHOLAS P. GODICI
*Acting Director of the United States Patent and Trademark Office*